US006976465B2

(12) United States Patent
Agapiades

(10) Patent No.: US 6,976,465 B2
(45) Date of Patent: Dec. 20, 2005

(54) DISC VALVE INTERMEDIATE RING SEAL

(76) Inventor: Thomas Agapiades, 744 Bridge St., Yuba City, CA (US) 95991

( * ) Notice: Subject to any disclaimer, the term of this patent is extended or adjusted under 35 U.S.C. 154(b) by 66 days.

(21) Appl. No.: 10/783,137

(22) Filed: Feb. 19, 2004

(65) Prior Publication Data

US 2005/0184269 A1 Aug. 25, 2005

(51) Int. Cl.[7] ..... F01L 7/00
(52) U.S. Cl. ..... 123/190.14; 123/190.17; 123/80 BB; 123/80 D
(58) Field of Search ..... 123/190.1, 190.4, 123/190.14, 190.17, 80 R, 80 BB, 80 D

(56) References Cited

*Primary Examiner*—Noah P. Kamen

(57) ABSTRACT

Between the cylinder head and combustion chamber of an internal combustion engine, an intermediate sealing ring. The sealing ring is in sliding contact at its top circular surface with a disc valve rotatively mounted in said cylinder head and at its outer periphery in fixed sealing contact with the inner surface of the engine cylinder of said engine combustion chamber. The purpose of the intermediate seal is to confine the working fluids, being acted upon by the reciprocating motion of the engine piston, across the stationary interface of the engine cylinder and rotative surface of the disc valve.

1 Claim, 1 Drawing Sheet

DISC VALVE INTERMEDIATE RING SEAL

BACKGROUND OF THE INVENTION

The invention is an intermediate ring seal placed in sliding contact at its upper ring surfaces with a rotatively mounted disc valve in an engine cylinder head. A sealing ring groove machined on the outer perimeter surface of the said ring holds a seal which is fixedly held by a pin in stationary contact with the inner surfaces of the engine cylinder.

In previous designs and proprietary illustrations, the stationary sealing contact has been in the cylinder head. In the present invention a ringed skirt has been placed within the inner diameter of the disc valve gear and extended downward over the outer surfaces of the engine cylinder. The stationary seal of the intermediate ring in the present invention is now at the engine cylinder inside surfaces.

The novelty of the present invention is in the method of sealing the combustion chamber of a rotary disc valve engine between the cylinder head and the engine cylinder. At the cylinder the intermediate ring seal provides a static seal with the engine cylinder by a seal operating within a seal groove machined into the outer surface of the intermediate ring seal. By this description, it can be seen that the intermediate ring seal comprises both dynamic and static sealing characteristics as a sealing interface between the rotating surfaces of the disc valve and stationary sealing surfaces of the engine cylinder.

Dynamic and static sealing between the rotating disc valve and stationary engine cylinder must occur within the limited axial length of the combustion volume. To alleviate this restrictive spatial requirement a skirt extension has been added to the disc valve which extends the axial length of the sealing contact between the dynamic seal and stationary seal without changing the combustion volume which would change the engine compression ratio and alter its performance.

The novelty of the invention is the extension of the axial distance between the dynamic seal and stationary sealing surfaces such that they overlap the interface between the cylinder head and engine cylinder, facilitating engine component manufacture and installation of the cylinder head on the engine cylinder with improved sealing reliability.

SUMMARY OF THE INVENTION

The invention is a new and improved method of sealing the combustion volume of a disc valve engine. The seal must provide dynamic sealing against the sliding surfaces of the disc valve and also provide static seal with the engine cylinder. These seals must be effective in the limiting axial length of the combustion volume measured as the distance between the engine piston crown and the cylinder head surface configured within the confining surface of the disc valve. To facilitate the sealing function the intermediate ring seal is designed to overlap the interface between the engine cylinder head and engine cylinder.

It is a primary objective of the invention to place a skirt extension on the disc valve that will overlap the interface between the engine cylinder head and the engine cylinder.

It is another objective of the invention to place the intermediate ring seal between the engine cylinder and the disc valve extension.

It is yet another object of the invention to place a static seal between the said engine cylinder and said intermediate ring seal.

BRIEF DESCRIPTION OF THE DRAWINGS

Drawings are presented showing the method of extending the lower portion of the disc valve to form a cylindered skirt. The drawings also show the method of installing an intermediate ring seal to provide a dynamic seal with the sliding surface of the disc valve and the static seal with the engine cylinder.

DETAILED DESCRIPTION OF THE INVENTION

In the detailed description of the invention, and its manner of operation, only three major components are required to define the novel features of the design.

Rotating disc valve

Intermediate ring seal

Stationary engine cylinder

The novel feature of the invention is the facilitation of the intermediate ring seal to effectively seal the combustion chamber of an engine by forming a dynamic sliding seal with the rotating disc valve and a static seal with the stationary engine cylinder within the limiting axial distance of the combustion volume when the engine piston is at top-dead-center at the end of its compression stroke. The novelty of the effective static sealing is achieved by extending the under side of the disc valve to form a cylindrical skirt that extends over the engine cylinder allowing for an intervening space for the intermediate ring to seal against the said engine cylinder.

Figure 1:
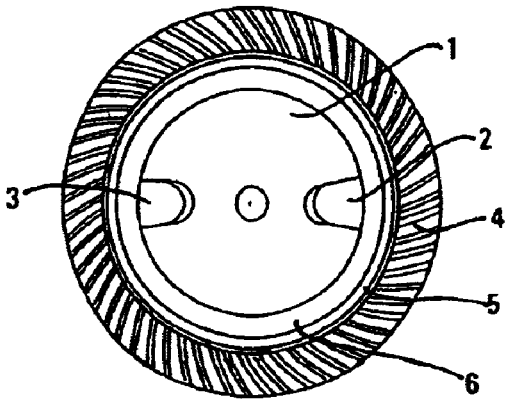
FIG. 1 Is the bottom view of the disc valve.

Turning now to FIG. 1 of the drawings. FIG. 1 is the bottom view of the disc valve 1 showing the intake port 2 and exhaust port 3, gear teeth 4, skirt 5, and sealing surface 6. The novel feature of the disc valve of FIG. 1 is skirt 5.

Figure 2:
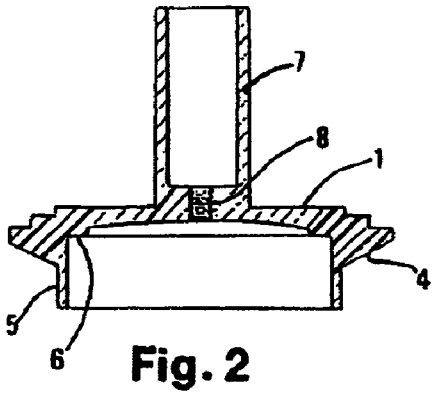
FIG. 2 Is a side view of the disc valve of FIG. 1 sectioned diagonally.

FIG. 2 is a side view of the disc valve 1 shown in cross-section taken across FIG. 1. In this view the disc valve axle 7 and spark plug threaded hole 8 are shown. Disc valve 1 is rotatively mounted in the engine cylinder head bearings which hold disc valve axle 7. Rotation of disc valve 1 opens and closes intake port 2 and exhaust port 3 in a synergistic manner with corresponding two ports in the cylinder head. Those skilled-in-the-art will readily recognize that disc valve 1 may have a plurality of intake ports 2 and exhaust ports 3 at slow rates of rotation relative to engine crankshaft revolution without effecting the novelty of design. In this description only one intake port 2 and one exhaust port 3 are shown for clarity and simplifiecation of the description.

Figure 3:
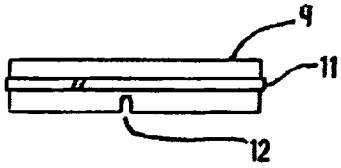
FIG. 3 Is a side view of the intermediate ring seal.

Turning now to FIG. 3. FIG. 3 is a side view of the intermediate ring seal 9. A groove 10 (not shown in this view) is machined on the outer perimeter of the said intermediate ring seal 9 to hold a stationary seal 11. At the bottom edge of intermediate ring seal 9 is a recess 12 for accepting a staking pin 16 (not shown in this view) for holding the intermediate ring seal in place and preventing its rotation.

Figure 4:
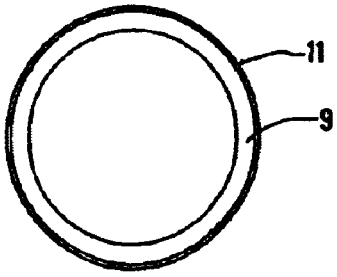
FIG. 4 Is a top view of the intermediate ring seal.

FIG. 4 is a top view of the intermediate ring seal 9.

Figure 5:
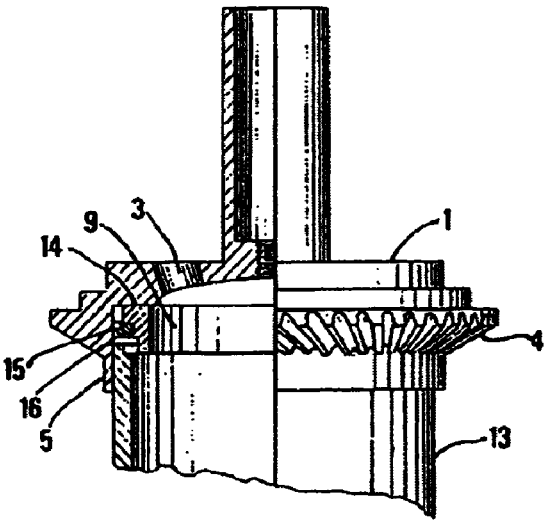
FIG. 5 Is a view of the assembly of the interfacing elements of the disc valve skirt with the static seal of the intermediate ring seal with the engine cylinder and the dynamic sliding seal with the disc valve sliding surfaces, shown in partial cross-section.

Turning now to FIG. 5. FIG. 5 shows the assembly of the disc valve 1, intermediate ring seal 9, and the engine cylinder 13 in partial cross-section. The sliding seal surface between the intermediate ring seal 9 and the disc valve 1 is shown as dynamic interface 14. The stationary seal 11 in contact with engine cylinder 13 is shown as static interface 15.

NUMBERED ELEMENTS OF THE DRAWINGS

1. disc valve
2. intake port
3. exhaust port
4. gear teeth
5. skirt
6. sliding seal surface
7. disc valve axle
8. threaded hole
9. intermediate ring seal
10. seal groove
11. stationary seal
12. groove
13. engine cylinder
14. dynamic interface
15. static interface
16. pin

What is claimed is:

1. An intermediate ring seal in rotative contact with a disc valve forming a dynamic seal at the interface of said rotative contact, said intermediate ring seal having a groove machined on the outer perimeter surface, said groove holding a stationary seal, said stationary seal in sealing contact with an engine cylinder, said intermediate ring seal having a recess at its bottom edge, a pin fixedly mounted in said engine cylinder and fitting into said recess to prevent rotation of said intermediate ring seal.

* * * * *